US005752641A

United States Patent [19]

Klas et al.

[11] Patent Number: 5,752,641

[45] Date of Patent: May 19, 1998

[54] SUSPENSION DRYER, IN PARTICULAR OFFSET DRYER

[75] Inventors: Ernst Klas, Siegburg; Bernd Wüstenhagen, Wesel; Udo Unger, Leichlingen, all of Germany

[73] Assignee: Vits-Maschinenbau GmbH, Langenfeld, Germany

[21] Appl. No.: 792,154

[22] Filed: Jan. 30, 1997

[30] Foreign Application Priority Data

Feb. 8, 1996 [DE] Germany ..... 296 02 178.4 U

[51] Int. Cl.[6] ..... B65H 20/00; F26B 13/00

[52] U.S. Cl. ..... 226/97; 34/643

[58] Field of Search ..... 226/97; 34/621, 34/639, 643, 644

[56] References Cited

U.S. PATENT DOCUMENTS

| | | | |
|---|---|---|---|
| 3,638,330 | 2/1972 | Stout | 34/643 |
| 3,823,488 | 7/1974 | Houben et al. | 226/97 X |
| 5,014,447 | 5/1991 | Hagen | 226/97 X |
| 5,156,312 | 10/1992 | Kurie . | |
| 5,395,029 | 3/1995 | Kurie | 226/97 |

FOREIGN PATENT DOCUMENTS

| | | | |
|---|---|---|---|
| 0 328 227 | 2/1989 | European Pat. Off. . | |
| 7228906 U | 8/1972 | Germany . | |
| 17 29 274 | 2/1978 | Germany | 34/643 |
| 2759666B2 | 5/1981 | Germany . | |
| 3815212C2 | 12/1988 | Germany . | |
| 3905472A1 | 2/1990 | Germany . | |
| 328455 | 4/1958 | Switzerland . | |

OTHER PUBLICATIONS

Patent Abstracts of Japan/M-1622 Jun. 16 1994 vol. 18/No. 317.

*Primary Examiner*—Michael Mansen
*Attorney, Agent, or Firm*—Michael J. Striker

[57] ABSTRACT

A suspension dryer for freshly moisturized webs of swellable paper has a row of lower nozzle beams which extend transversely to a throughgoing direction so as to be spaced from one another along a dryer length with a distance from one another and provided at an upper side with blowing openings, a row of upper nozzle beams extending transversely to the throughgoing direction at a distance from one another along the dryer length so as to be offset relative to the lower nozzle beams and provided on a lower side with blowing openings, a width of the nozzle beams arranged in an initial portion of the dryer length is greater than a width of the nozzle beams arranged in the remaining portion of the dryer length, and a distance between two adjacent ones of the nozzle beams arranged in the initial portion is greater than a distance between two adjacent ones of the nozzle beams arranged in the remaining portion.

8 Claims, 3 Drawing Sheets

SUSPENSION DRYER, IN PARTICULAR OFFSET DRYER

BACKGROUND OF THE INVENTION

The present invention relates to a suspension dryer, and in particular to an offset dryer.

Suspension dryers are known in the art. The known suspension dryers possess an old problem that the contactlessly guided material webs have a tendency to form longitudinal folds. This is connected in particular with the width expansion. This problem is disclosed for example DE-Z "Holz Als Roh-Und Werkstoff" 34 (1976) 275–279. By the offset arrangement of the lower and upper nozzle beams a wave-shaped web guidance is provided. Thereby the web is reinforced in the transverse direction and the formation of folds parallel to the throughgoing direction is suppressed.

The amplitude of the sine wave depends on the one hand on the pressure which is applied by a flow blown from the nozzles onto the web, and on the other hand on the pulling tension which is effective the web. In the case of excessive web tension the web is pulled flat, so that the transverse reinforcement is pronounced weaker. In the case of low pulling tension, the wave peak grows, so that it streaks the nozzle beam. The pressure forces depend on the speed and the quantity of the blown air as well as on the type of the nozzle beams.

During drying it is necessary to increase the power density as wide as possible to maintain the drying length as short as possible. This is achieved by high air speed, arrangement of many small nozzle beams per length unit, and short distances between the planes in which the openings of the lower and upper nozzles are located.

In many applications it is necessary to satisfy often contradictory requirements resulting on the one hand from the need of a stable and fold-free web guidance, and on the other hand from the transportation with high power density. In modern offset dryers the distance between the plane in which the openings of the lower nozzles are located and the plane in which the openings of the upper nozzles are located is as a rule 5–12 mm. The typical nozzle beam has a width of substantially 50–100 mm, and a typical distance between the neighboring nozzle beams (center to center) is located between 100 and 300 mm. The typical pulling tension amounts to substantially 500N per m of web width. With this parameter combination, the formation of waves is so weak that it can not be recognized.

While the above mentioned predetermined parameter combination has been proven for years to be the best with respect to the web guidance, fold-free situation and power density in the praxis, a new problem has arisen lately consisting in that, possibly in connection with the use of other paper types, the web contacts the nozzle beams so that a printing ink is smeared. With accurate analyzes it has been shown that the contact is always performed in the first third of the drying length. It has been further shown that the position of the region in which the contact occurs depends on the web speed. In the case of small web speed this region is located immediately near the inlet, while in the case of the high web speed it travels further into the dryer.

An expansion of the web in a transverse direction has been recognized as a cause of this new phenomenon. This is obviously caused when in the printing mechanism a greater quantity of water than before penetrates the paper and the web tends to swell. Depending on the throughgoing speed, the point of the maximum width is located near the inlet slot or in a substantially greater distance from it, which however in the case of the maximum web speed is not greater than a third of the dryer length. When the maximum width is achieved, the web starts to shrink because of the drying. The expansion in the transverse direction leads, in addition to the fact described in the above mentioned document DE-Z to a stronger formation of longitudinal folds. They have a height of substantially 8 mm and therefore contact the nozzle beam. The weakly formed transverse waves have no sufficient reinforcing effect. The nozzle jets have also no significant width streaking effect. The corresponding features to increase the distance between the lower and the upper beams to avoid the contact can not lead to the results. They destabilize the suspension position with edge flatter and tearing of the web.

The European patent document EP 0 192 169 B1 discloses a contactless guidance of product webs in cases in which it is especially difficult to provide web stability and fold-free situation on the one hand and high power density on the other hand. The proposed solutions includes arranging the surfaces of the openings of the upper and lower nozzles to correspond to the desired wave shape performed by the web. This device is provided especially for the heat treatment of metal bands.

The German document DE 38 15 212 C2 has an objective to combine in a suspension dryer a good heat transmission with good stability of the product web. The nozzle beams formed as air pad nozzles are each formed with two nozzle slots arranged at a distance from one another and they are greater than usual. The total width amounts to substantially 13.35 cm. Also, the distance between the neighboring nozzle boxes is greater than usual, in particular 30.48–38.1 cm.

SUMMARY OF THE INVENTION

Accordingly, it is an object of present invention to provide a suspension dryer which avoids the disadvantages of the prior art.

In keeping with these objects and with others which will become apparent hereinafter, one feature of the present invention resides, briefly stated, in a suspension dryer in which the width of the nozzle beam arranged in an initial portion of the dryer length is greater than the width of the nozzle beam arranged in remaining portion of the dryer length, and the distance between two neighboring nozzle beams arranged in the initial portion is greater than the distance between two neighboring nozzle beams arranged in the remaining portion.

When the suspension dryer is designed in accordance with the present invention, it eliminates the disadvantages of the prior art.

In the inventive dryer even freshly moisturized webs of swellable paper are guided in an initial portion of the dryer length in a fold-free manner without streaking of the nozzle beam.

In accordance with another feature of the present invention, the initial portion has a partial length of 10–35% of the total dryer length.

In accordance with the invention, all nozzle beams in the initial portion can have the same width and can be arranged at equal distances.

In accordance with the invention, the widths of the nozzle beams in the initial portion as well as the distance between the neighboring nozzle beams can reduce in a stepped manner in the throughgoing direction.

In accordance with the invention, in the remaining portion, all nozzle beams can have the same width and arranged at the same distances from one another.

In accordance with the invention, duration between the maximum and minimum width as well as the ratio between the maximum and the minimum distance can amount to between 2:1 and 3:1.

In accordance with the invention, the nozzle beams can be formed as air pad nozzles.

Finally, the openings of blow openings of the lower nozzle beams can be arranged in a horizontal lower plane, while the openings of the blow openings of the upper nozzle beams can be arranged in an upper plane, and the distance between the planes can be constant over the whole dryer length.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
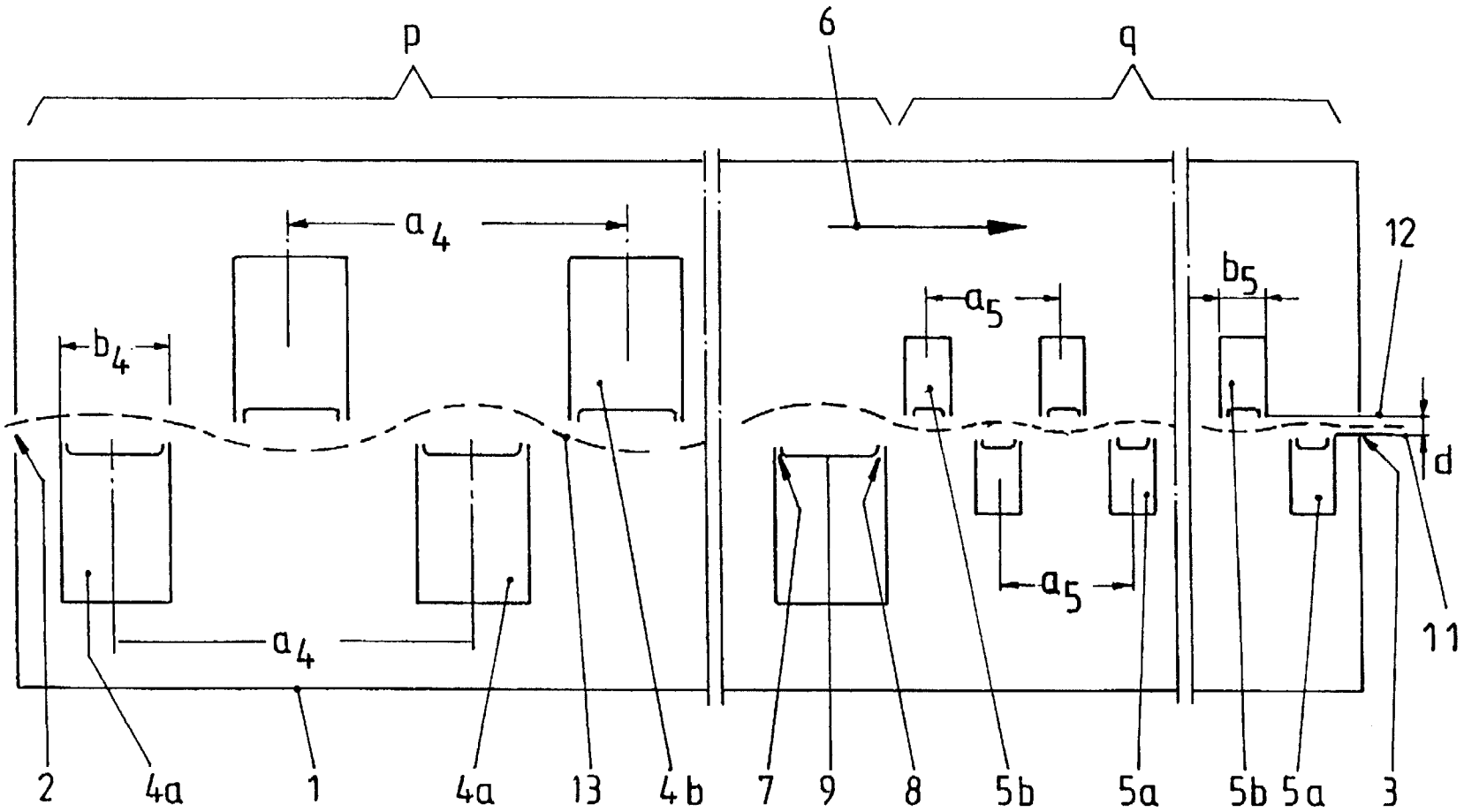
FIG. 1 is a view showing a suspension dryer in accordance with one embodiment of the present invention.

As can be seen from FIG. 1, a suspension dryer in accordance with the present invention has a housing which is identified as a whole with reference numeral 1. The housing is provided with an inlet slot 2 an outlet slot 3 defining a dryer length. Horizontal nozzle beams 4*a*, 4*b*, 5*a*, 5*b* are arranged along the dryer length and extend transversely to a throughgoing direction identified with the arrow 6. The nozzle beams 4*a* and 5*a* form a lower row while the nozzle beams 4*b*, 5*b* form an upper row. The nozzle beams 4*a*, 4*b* are arranged in an initial portion p of the dryer length starting from the inlet gap 2, while the nozzle beams 5*a*, 5*b* are arranged in a remaining portion q. The initial portion p extends over approximately 10–35% preferably substantially ⅓ of the total dryer length.

The nozzle beams 4*a*, 4*b* located in the initial portion p have a uniform width $b_4$. The nozzle beams 5*a*, 5*b* have also a uniform width $b_5$ which is substantially smaller than the width $b_4$. The ratio $b_4$:$b_5$ is located between 2:1 and 3:1.

A distance $a_4$ is provided between two neighboring nozzle beams 4*a* (center-to-center) and the same distance is provided between two neighboring nozzle beams 4*b*. A distance $a_5$ is provided between two neighboring nozzle beams 5*a*, and the same distance is provided between two neighboring nozzle beams 5*b*. The upper nozzle beams 4*b* are offset relative to the lower nozzle beams 4*a*, so that a gap between two neighboring nozzle beams 4*a* is located opposite to one nozzle beam 4*b*, preferably substantially centrally. In a corresponding manner, the nozzle beams 5*a*, 5*b* are arranged so that they are offset relative to one another.

The nozzle beams 4*a*, 4*b*, 5*a*, 5*b* are formed as a pad nozzles. For example, the nozzle beam 4*a* has a substantially hollow box which is composed of metal sheets with a rectangular cross-section. It is provided on its upper side which faces the side walls with two blowing slots 7 and 8, extending over the total length of the nozzle beams 4*a*, or in other words substantially over the working width of the suspension dryer. A web sheet 9 is located between the blowing slots 7, 8. The remaining nozzle beams 4*b*, 5*a*, 5*b* are formed correspondingly, however in the upper nozzle beams 4*b*, 5*b* the blowing slots are arranged on the lower side. The openings of the blowing slots of the lower nozzle beams 4*a*, 5*a* are located in a horizontal plane 11, while the openings of the blowing slots of the upper nozzle beams 4*b*, 5*b* are located in a horizontal plane 12. The distance d between the two planes is constant over the whole length of the dryer. Typical dimensions are presented in the following table and given in mm.

| Dimensions | MM |
|---|---|
| $a_4$ | 200–500 |
| $a_5$ | 100–300 |
| $b_4$ | 100–250 |
| $b_5$ | 50–100 |
| d | 5–12 |

Each nozzle beam 4*a*, 4*b*, 5*a*, 5*b* is provided for example on an end side with an inlet opening for a drying medium. The inlet opening, as known in the art, is connected with a not shown passage which communicates with a pressure side of a not shown passage, which in turn communicates with a pressure side of a not shown fan. The dryer can be composed of several successive fields with separate systems for circulation of the drying medium.

During the operation a freshly printed paper web is supplied to the suspension dryer. In addition to the printing ink, the web is supplied in the printing mechanism with water. A predetermined longitudinal tensioning of for example 500N/m is maintained by preceding or subsequent devices which correspond to the prior art and do not belong to the present invention. The paper web is loaded over the total drying length with hot air by the nozzle beams 4*a*, 4*b*, 5*a*, 5*b*. In the region of the initial portion the forces applied by the flow are relatively high. The paper web assumes in this region a corrugated shape. Thereby it is stretched in the transverse direction, so that the formation of longitudinal folds is suppressed.

In the remaining region q the aerodynamic forces are substantially smaller. The height of the waves is so small that the web is pulled by the longitudinal tension approximately mirror-smooth. A reinforcing in a transverse direction is available in a correspondingly lower degree. In the portion q the drying power supplied per length unit is substantially high.

The paper web 13 at the end of the initial portion p is dried so that the widening because of the swelling exceeds the maximum or at least reaches it. An increased tendency to formation of longitudinal folds no longer occurs in the portion q. The formation of longitudinal folds is excluded by the nozzle arrangements and operational parameters corresponding to the prior art. In the embodiment shown in FIG. 2, the nozzle beams 14*a*, 14*b*, 15*a*, 15*b* have a different cross-sectional shape than in FIG. 1. The both blowing slots 17, 18 are limited by inclined guiding surfaces which are formed on the edges of the side walls and the web plates 19 of the nozzle beam. The web plate 19 is perforated. The nozzle beams on a side which faces away from the web plate 19 merge into a wedge-shaped narrowed passage which is connected with a not shown air distributing box.

The width of the nozzle beams 14*a*, 14*b* in the initial portion p is reduced in several steps, for example from one nozzle beam to the other nozzle beam. The same is true for the distance between the neighboring nozzle beams. In the remaining portion q, all nozzle beams 15*a*, 15*b* have the same width and are arranged at the same distances.

As for the operation of the device in accordance with this embodiment, it is the same as in the device shown in FIG. 1. The only difference is that in the initial portion p, the height of the waves reduces from one wave to the other.

The inventive suspension dryer does not limit a shape of the nozzle beams. It is utilizable with all nozzle beams which are suitable to stabilize a throughgoing web in a wave shape aerodynamically in the suspension with offset arrangement of the upper and lower nozzle beams. Many suitable nozzles can be used which are known from the prior art.

Figure 2:
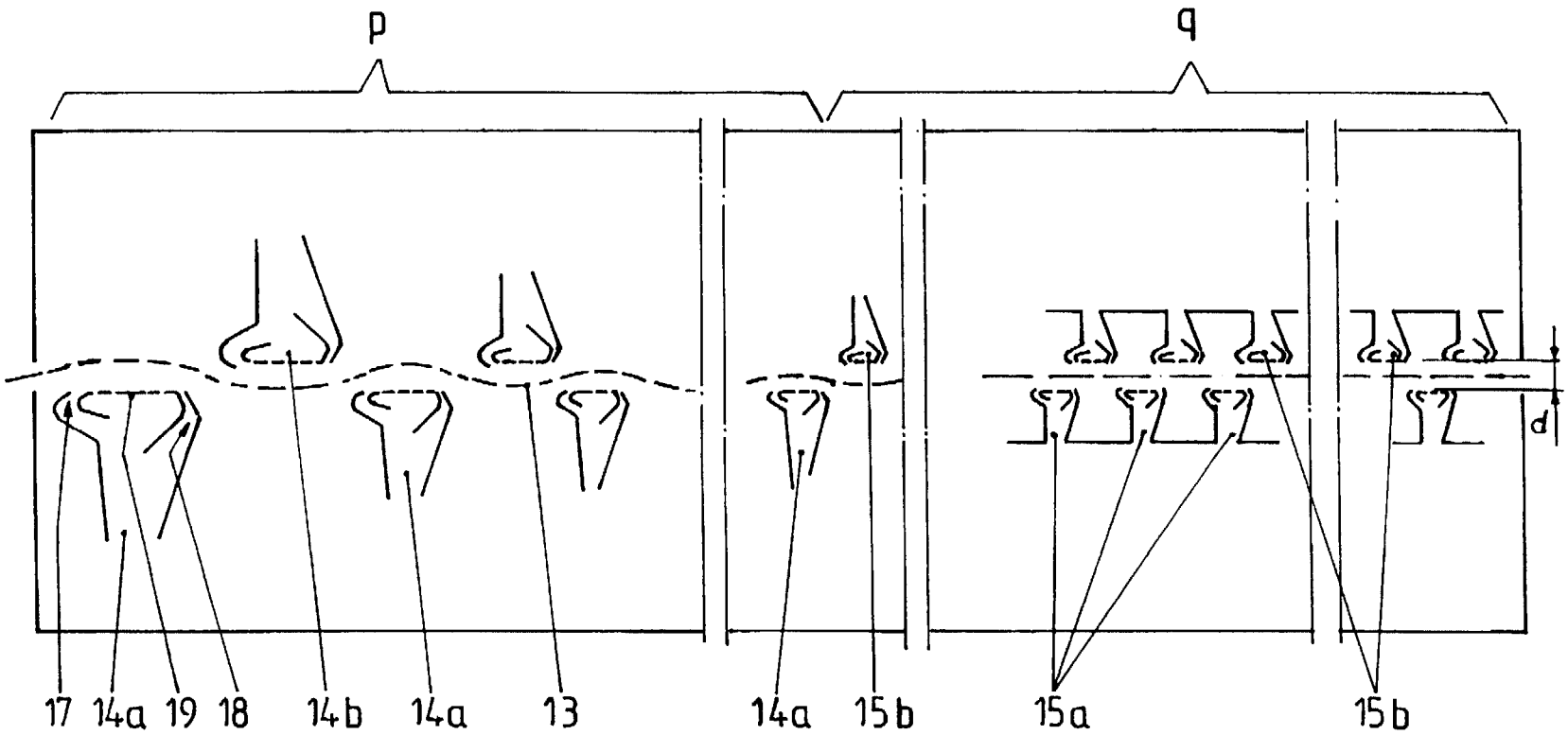
FIG. 2 is a view showing a suspension dryer in accordance with another embodiment of the present invention.
Figure 3:
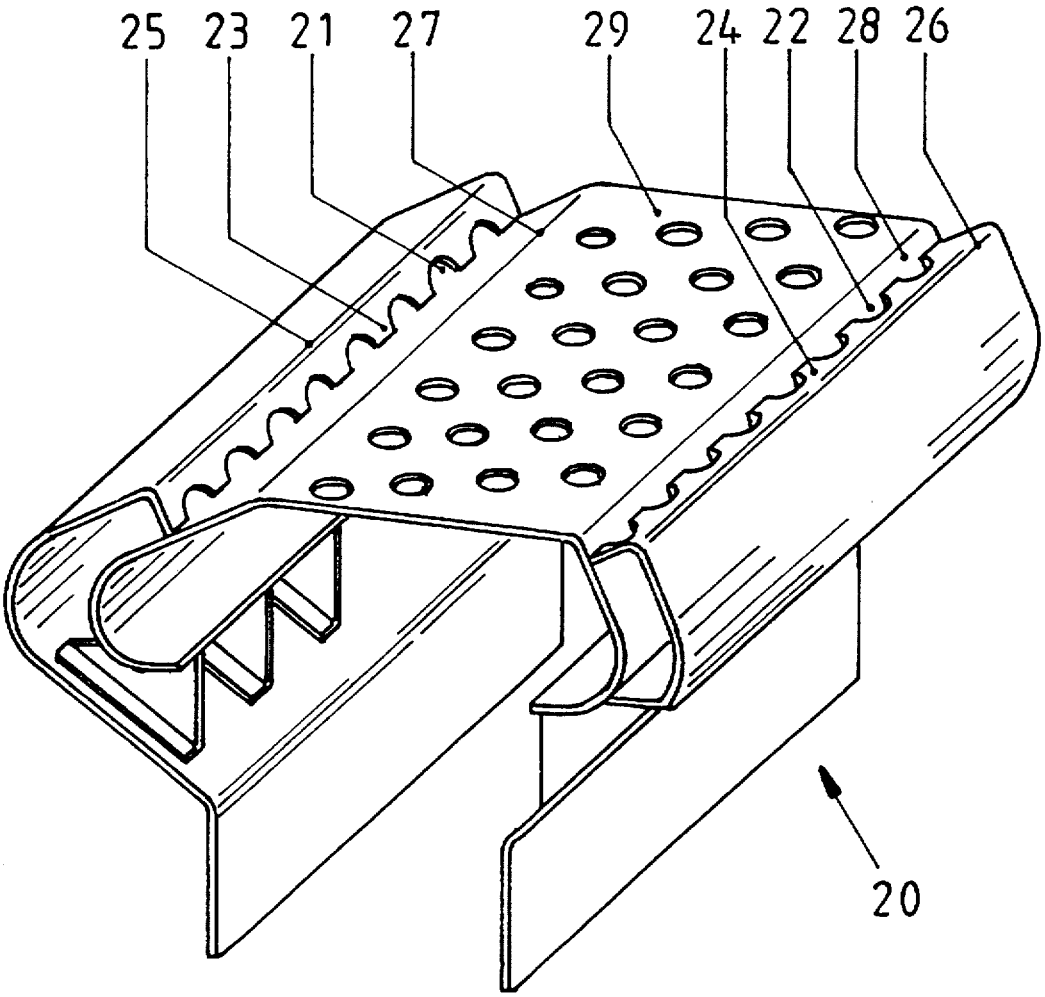
FIG. 3 is a perspective view showing a nozzle beam for a suspension dryer in accordance with the present invention.

A preferable nozzle beam 20 shown in FIG. 3 has a cross-section which is similar to the cross-section of the nozzle beam in FIG. 2. It is however different in that the blowing slots are replaced with perforation rows. The perforations, as disclosed for example in the German document DE 26 13 135 B2 are formed as semi-circular recesses 21, 22 provided on angled edge strips 23, 24 of the side walls 25, 26. The edge strips 23, 24 are supported with pretensioning on inclined guiding surfaces 27, 28 on the edges of the perforated web plate 29. The blow jets exiting the recesses 21, 22 are oriented so that they are inclined relative to one another.

It will be understood that each of the elements described above, or two or more together, may also find a useful application in other types of constructions differing from the types described above.

While the invention has been illustrated and described as embodied in suspension dryer, in particular offset dryer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A suspension dryer for freshly moisturized webs of swellable paper, comprising a row of lower nozzle beams which extend transversely to a throughgoing direction so as to be spaced from one another along a dryer length with a distance from one another and provided at an upper side with blowing openings; a row of upper nozzle beams extending transversely to the throughgoing direction at a distance from one another along the dryer length so as to be offset relative to said lower nozzle beams and provided on a lower side with blowing openings, a width of said nozzle beams arranged in an initial portion of the dryer length being greater than a width of said nozzle beams arranged in the remaining portion of the dryer length, and a distance between two adjacent ones of said nozzle beams arranged in the initial portion being greater than a distance between two adjacent ones of the nozzle beams arranged in said remaining portion.

2. A suspension dryer as defined in claim 1, wherein said initial portion extends over a partial length of 10–35% of a total dryer length.

3. A suspension dryer as defined in claim 1, wherein said nozzle beams in the initial portion have a same width and are arranged at same distances from one another.

4. A suspension dryer as defined in claim 1, wherein said nozzle beams in the initial portion have width and are arranged from one another at distances which reduce in a stepped manner in the throughgoing direction.

5. A suspension dryer as defined in claim 1, wherein said nozzle beams in the remaining portion have the same width and are arranged at same distances from one another.

6. A suspension dryer as defined in claim 1, wherein a ratio between a maximum width and a minimum width of said nozzle beams and a ratio between a maximum distances and a minimum distances between said nozzle beams is substantially between 2:1 and 3:1.

7. A suspension dryer as defined in claim 1, wherein said nozzle beams are formed as air pad nozzles.

8. A suspension dryer as defined in claim 1, wherein said blowing openings of said lower nozzle beams have mouths arranged in a horizontal lower plane, and the blowing openings of said upper nozzle beams have mouths arranged in a horizontal upper plane, such that a distance between said planes is substantially constant over the dryer length.

* * * * *